United States Patent [19]

Gray

[11] 4,449,524

[45] May 22, 1984

[54] SELF-CONTAINED BREATHING APPARATUS WITH PROVISION FOR SHARED USE

[75] Inventor: Robert E. Gray, Clearwater, Fla.

[73] Assignee: Litton Systems, Inc., Frederica, Del.

[21] Appl. No.: 358,504

[22] Filed: Mar. 15, 1982

[51] Int. Cl.[3] ..... A62B 7/04

[52] U.S. Cl. ..... 128/202.27; 128/204.26; 128/205.24; 128/204.18

[58] Field of Search ..... 178/202.77, 204.18, 178/204.26, 201.28, 912, 205.24

[56] References Cited

U.S. PATENT DOCUMENTS

| | | | |
|---|---|---|---|
| 2,764,151 | 9/1956 | Cupp | 128/202.22 |
| 2,854,001 | 9/1958 | Humblet | 128/202.22 |
| 3,433,222 | 3/1969 | Pinto | 128/202.27 |
| 3,995,626 | 12/1976 | Pearce, Jr. | 128/205.24 |

*Primary Examiner*—Henry J. Recla

*Attorney, Agent, or Firm*—Brian L. Ribando

[57] ABSTRACT

Self-contained breathing apparatus comprising a portable tank containing a supply of breathing air under high pressure, a main pressure regulator for reducing the pressure of air from the tank to a moderate level, a face mask having a demand valve mounted thereon which receives air from the main pressure regulator through a main supply hose and which controls the pressure and flow thereof to meet the users requirements, a bypass pressure regulator and flow control means which receives air from the tank and which controls the pressure and flow of air to the mask, through a separate bypass hose, to provide breathing air to the mask in the event of a fault in the main breathing circuit. The bypass hose is attached to the bypass pressure regulator and flow control by means of manually operable quick disconnect fitting, enabling emergency sharing of the air supply by a second, similarly equipped user.

3 Claims, 3 Drawing Figures

SELF-CONTAINED BREATHING APPARATUS WITH PROVISION FOR SHARED USE

The present invention relates to self-contained breathing apparatus. More particularly, it relates to breathing apparatus intended for use by firemen or other personnel working in extremely hazardous atmospheres which includes means enabling one equipped person to share his air supply with a similarly equipped person without abnormal effect on the breathing of either person.

Presently available self-contained breathing apparatus comprises a tank containing a supply of highly compressed air, a pressure regulator for reducing the pressure of air from the tank to a moderate level, a face mask or mouthpiece through which air is supplied to the user and a demand valve interposed between the pressure regulator and the face mask for further reducing the pressure of air from the regulator to near atmospheric and for controlling the flow thereof to meet the demands of the user.

The apparatus is designed with the intent of providing complete portability while interfering with the user's freedom of movement and comfort a minimum amount. The bulky and heavy air tank is carried as a backpack. The pressure regulator may be formed integrally with the air tank outlet or it may be mounted at the user's waist or chest for better accessibility. The demand valve may be incorporated with the pressure regulator if the latter is waist or chest mounted or the demand valve may be made part of the face mask. The face mask mounted demand valve has an advantage over body mounted demand valves in that the air hose supplying the face mask valve can be of comparatively small bore since the air moving therethrough is at moderately high pressure and at low volume. Small bore hose can be made of tough material and protected by an armor sheath while still retaining adequate flexibility to permit free head movement of the user. On the other hand, air from a body mounted demand valve must be supplied to the face mask through a comparatively large bore tube because it is at low pressure and high volume. The larger bore tubing can only be made sufficiently flexible by constructing it with thin walls which are ordinarily corrugated to provide additional flexibility and to prevent collapsing when the tube is bent or pressed. Such thin wall tubing is far more vulnerable to damage by tears, flying embers or other causes than is a small bore armor protected air hose.

Under certain conditions safety regulations require that the apparatus also include means for bypassing the demand valve so that the user can still receive breathing air if the demand valve should fail. In prior apparatus, the demand valve bypass means comprises a passage intersecting the air line from the pressure regulator to the demand valve in close proximity to the demand valve inlet. Air pressure and flow through the bypass are controlled by a manually operated needle valve and an orifice, the outlet of which enters the face mask supply line at a point near the demand valve outlet. While such construction provides air supply to the face mask in the event of failure of the demand valve alone, in the case of a body mounted demand valve, no air would be supplied to face mask if the supply tube thereto were also torn or obstructed and in the case of a face mask mounted demand valve, no air would be supplied if the hose from the pressure regulator to the mask were also torn or obstructed.

The present invention is an improvement in prior self-contained breathing apparatus of the sort having a face mask mounted demand valve. The improvement comprises a bypass pressure regulator and flow limiting orifice connected to the face mask through a small bore bypass hose to feed air directly to the face mask. The bypass air hose is connected to the bypass pressure regulator by a quick-disconnect type fitting. This feature enables one user equipped with the apparatus of the invention to provide emergency aid to a similarly equipped user by disconnecting his own bypass hose and connecting the second user's bypass hose in place thereof. The first user continues to receive air through the main pressure regulator and demand valve while the second user receives air through his bypass hose connected to the first user's bypass pressure regulator.

Heretofore, provision has been made for the emergency sharing by two persons of a single air source by arrangements which, in effect, permit the coupling together of the outlets of the air or oxygen tanks of the systems, as in U.S. Pat. Nos. 3,575,167 and 4,111,342 or which permits one user to couple his face mask supply hose into the face mask of another, as in U.S. Pat. No. 3,238,943. Still another measure for emergency sharing in underwater breathing systems is to equip the system with dual mouthpieces, as in U.S. Pat. No. 3,219,034 and in U.S. Pat. No. 3,433,222 an underwater breathing system is disclosed which includes two high pressure air hoses from the air tank to the diving helmet, one of which supplies air to a demand valve and the other of which supplies air to helmet earpieces. Both hoses are provided with quick-disconnect fittings at the helmet. In an emergency a distressed diver may disconnect the ear piece supply hose of a fellow diver and use it as his demand valve supply.

Known prior art arrangements for two party emergency use of a single breathing air supply do not include any arrangement for bypassing the demand valve when the system is in normal use by a single person.

It is an object of the present invention to provide, in a self-contained breathing apparatus having a demand valve for controlling the flow of breathing air, demand valve bypass means which may be activated, in the event of a demand valve failure, to provide breathing air to the user at a constant flow which is adequate to sustain the user but which is not so high as to prematurely deplete the air supply.

It is another object of the invention to provide in such breathing apparatus demand valve bypass means which may be activated to maintain a flow of breathing air to the user in the event of interruption of the air supply to the demand valve.

It is still another object of the invention to provide, in such breathing apparatus, demand valve bypass means which enables a first user to share his air supply with a second similarly equipped user without interfering in the flow of breathing air demanded by the first user.

Briefly, the present invention comprises a self-contained breathing apparatus which includes an air tank, a main pressure regulator for reducing the high pressure of the tank to a moderate pressure, a face mask with a demand valve mounted thereon which is supplied with moderate pressure air from the regulator and demand valve bypass means. The bypass means include a separate pressure regulator for reducing high air tank pressure to a pressure of about 150 p.s.i. which pressure is further reduced to a pressure only slightly elevated above atmospheric and the air flow is limited by an orifice connected to the output of the bypass pressure regulator. A separate small bore hose is connected to the orifice by a quick-disconnect type fitting for feeding breathing air directly from the orifice to the face mask. The quick-disconnect fitting of the bypass hose includes an auto-closing valve which seals the bypass hose upon detachment of the fitting from the bypass orifice. Thus, in an emergency involving a second user of similar equipment, a first user may detach his bypass hose and attach the bypass hose of the second user, whereafter the first user continues to receive air in the normal demand mode without interfering in his breathing requirements, while the second user receives air in the bypass mode from the first user's supply.

Figure 1A:
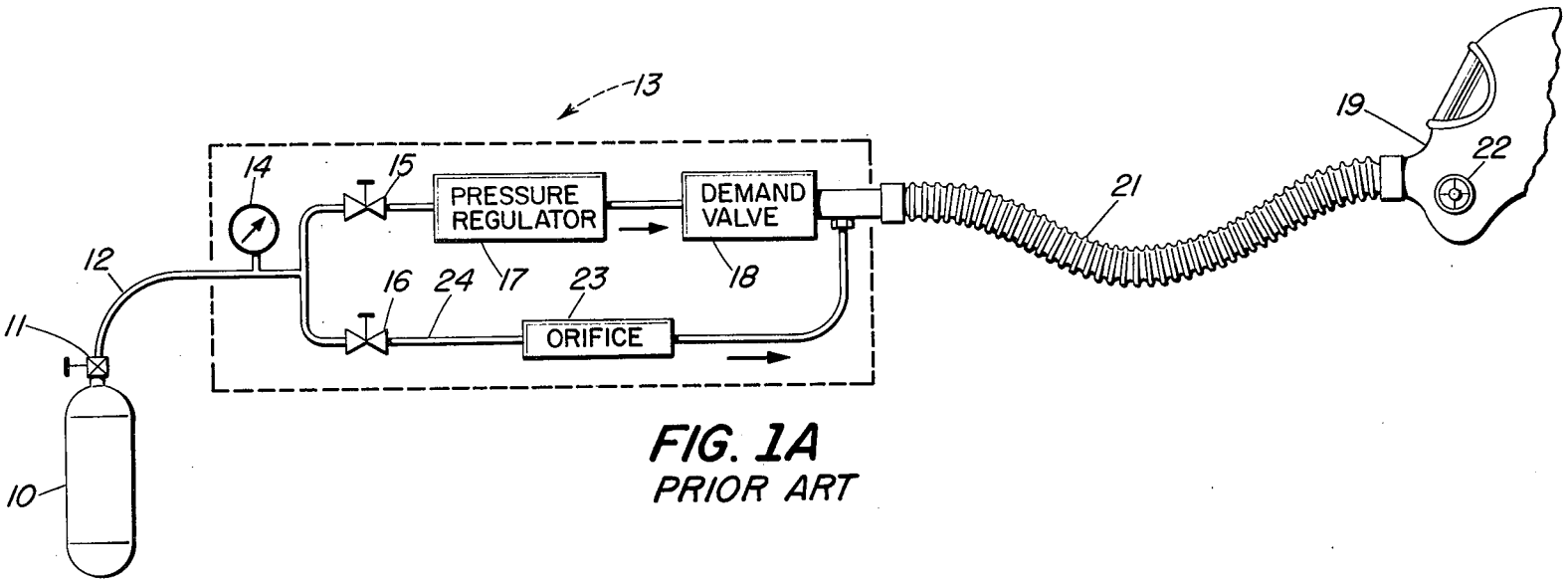
FIG. 1A PRIOR ART
FIG. 1A is a pictorial view, partially in schematic form, showing prior art self-contained breathing apparatus having a body mounted demand valve and demand valve bypass means.

FIG. 1A shows one form of prior art self-contained breathing apparatus which includes demand valve bypass means. An air tank 10 of a size permitting its easy carriage, usually as a backpack with a cradle and harness (not shown), contains a supply of breathing air at a pressure of 2000–4500 p.s.i. The air tank 10 includes a shut-off valve 11 formed as an integral part thereof to allow convenient substitution of charged tanks for exhausted ones. A small bore, high pressure hose 12 connects the output of valve 11 to a body mounted demand valve unit 13 which may be carried at the user's waist or chest. Unit 13 includes a tank pressure gage 14 for monitoring the available air supply during use of the system. High pressure air is supplied to the inlets of a main shut-off valve 15 and a bypass needle valve 16. In normal use, valve 15 is fully open and valve 16 is closed. A pressure regulator 17 reduces the pressure of the air flowing through valve 15 from the high tank pressure to a substantially constant, moderate pressure of about 150 p.s.i. A demand valve 18 receives constant pressure air from regulator 17 and reduces the pressure and controls the flow thereof for supply to a face mask 19 through a large bore flexible hose 21. Demand valve 18 may be any of several known types which are capable of reducing the pressure of the inlet air from about 150 p.s.i. to a low positive pressure of about 1 inch w.c. (water column) at flow rates of from between 0 and about 200 liters per minute. The low positive pressure is maintained at all times within the mask when the system is in use to provide a positive seal between the mask and the face of the user and to minimize the influx of noxious gases should the seal be broken. The demand valve controls the flow of breathing air to the mask in response to pressure variatons created by the respiration of the user. Upon inhalation the pressure within the mask tends to drop below the maintenance pressure level, thereby signalling the demand valve to increase flow. Upon exhalation, mask pressure tends to rise above the maintenance level, signalling the valve to shut-off flow. The exhaled gases are voided from the mask through a spring-loaded exhaust valve 22.

The demand valve bypass of FIG. 1A includes needle valve 16 and a flow limiting orifice 23 interposed in the conduit 24 connected to the outlet of valve 16 the inlet to hose 21. Should a fault occur in the pressure regulator 17 or demand valve 18 of the main breathing circuit, valve 15 is closed and valve 16 is opened to provide a constant flow of air to the face mask 19. The extent to which valve 16 is opened is dependent entirely upon the user's judgment of an adequate flow. In an emergency it is the usual tendency of the user to set the air flow at a greater than needed rate, thereby further imperiling his survival.

Figure 1B:
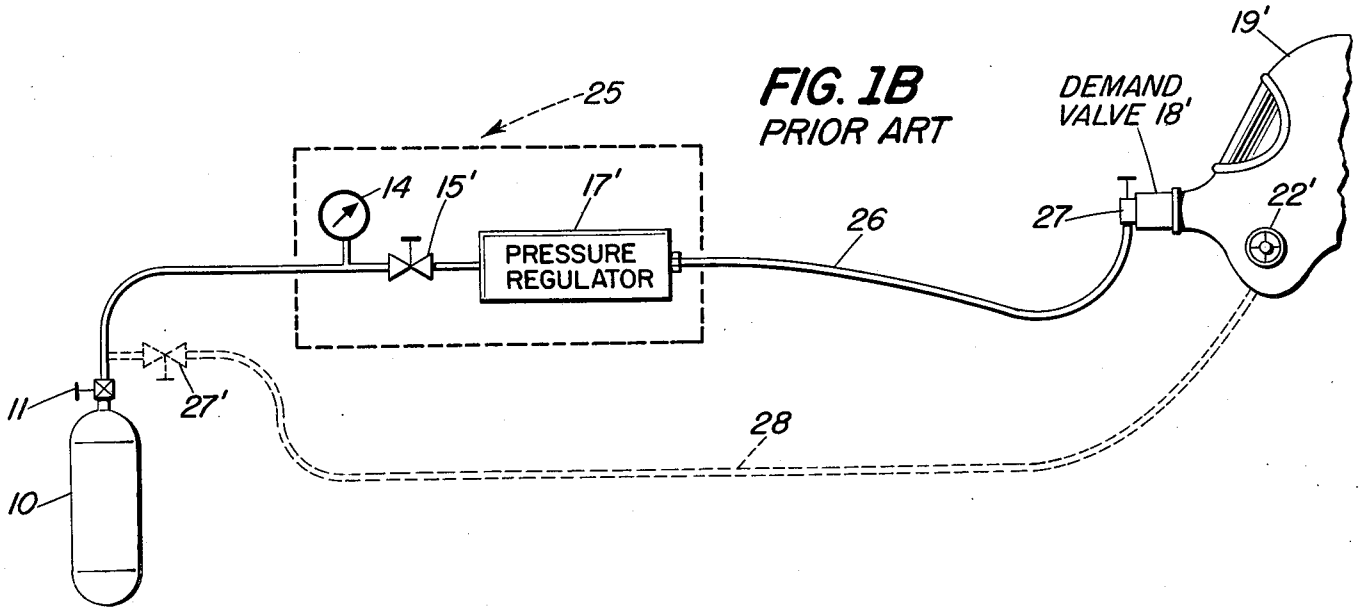
FIG. 1B PRIOR ART
FIG. 1B is a similar view of another type prior art self-contained breathing apparatus having a face mask mounted demand valve and demand valve bypass means.

Two other versions of prior art breathing systems with demand valve bypass are shown in FIG. 1B. One version, shown in solid lines, includes the necessary air tank 10 and tank shut-off valve 11. The tank pressure gage 14, main breathing circuit shut-off valve 15' and pressure regulator 17' may all be contained in a body mounted unit 25. The demand valve 18' is formed integrally with the face mask 19'. The outlet pressure of regulator 17' is about 150 p.s.i., thereby permitting the use of a small bore, thick wall hose 26 for carrying air from the pressure regulator to the demand valve inlet. Hose 26 also supplies air to a bypass needle valve 27 mounted on the face mask 19'. Air at reduced pressure flows from bypass valve 27 through a limiting orifice (not shown) directly to the interior of mask 19'. In a variation of this system, shown in dotted lines, the bypass needle valve 27' is relocated to a position adjacent the tank shut-off valve 11 and an additional small bore, thick walled hose 28 carries air from the outlet of bypass valve 27' directly to the interior of face mask 19'.

The prior art systems of FIGS. 1A and 1B each provide means for bypassing the system demand valve should a fault arise therein. All of these systems may be wasteful of breathing air when operating in the bypass mode since the user is at liberty to determine the flow rate by adjustment of the bypass needle valve. None of these prior art systems provide for the sharing of the same air supply by two users in such a manner as to not interfere with the breathing of either user and without exposure of either user to the hazardous atmosphere which may surround them.

Figure 2:
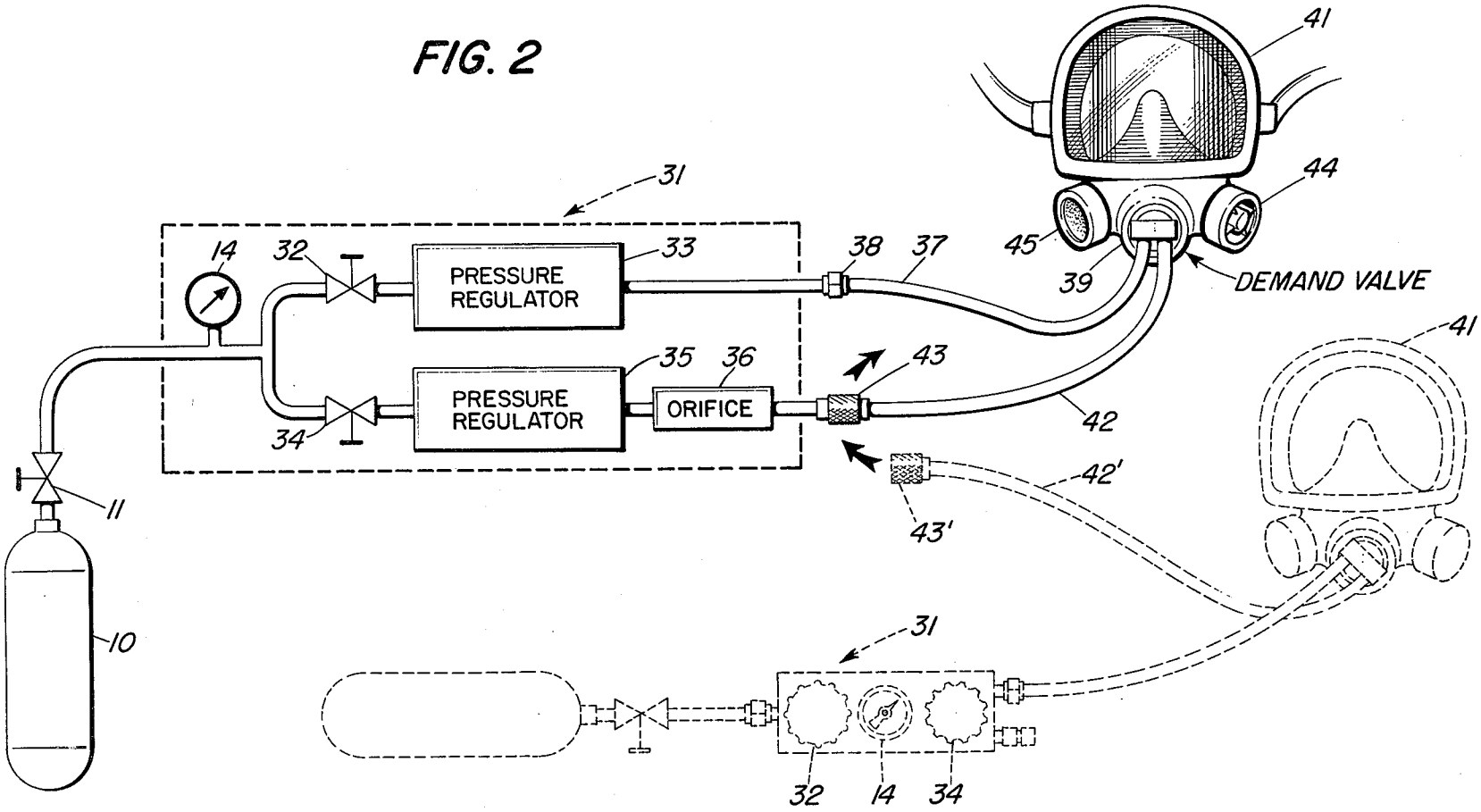
FIG. 2 is pictorial view, partially in schematic form, showing the self-contained breathing apparatus of the invention and showing the manner in which one user may share his air supply with another, similarly equipped user.

FIG. 2 illustrates the breathing apparatus of the invention. The air tank 10 and tank shut-off valve 11 are conventional. A body mounted modular housing 31 includes a tank pressure gage 14, a main breathing circuit shut-off valve 32 and pressure regulator 33. Housing 31 also includes a bypass shut-off valve 34, bypass pressure regulator 35 and a flow limiting orifice 36. A small bore, thick walled hose 37 is semi-permanently attached to the outlet of main pressure regulator 33 by a wrench tightened fitting 38. Hose 37 leads to the inlet of a demand valve 39 mounted on a face mask 41. A second small bore, thick walled hose 42 is connected to the outlet of bypass orifice 36 by a quick-disconnect type fitting 43. Hose 42 leads directly to the interior of mask 41. The quick-disconnect fitting 43 is a commercially available type which includes an auto-closing valve for sealing the end of hose 42 when the fitting is detached from its mating part. As will be understood, hose 42 may be quickly detached from the outlet of orifice 36 by retracting with the fingers the outer knurled shell of fitting 43.

The system may be designed for use with an air tank having a maximum pressure of 2200 p.s.i. or to provide longer periods of use, the system may be designed for a tank having a maximum pressure of 4500 p.s.i. Depending on the system design, main pressure regulator 33 receives inlet air at a pressure of 2200 or 4500 p.s.i. and regulates the pressure to a substantially constant outlet pressure of about 150 p.s.i. for supply to demand valve 39. Demand valve 39 reduces the pressure of the inlet air to a substantially constant one inch w.c. mask pressure and controls the flow thereof in accordance with the breathing requirments of the user. Bypass pressure regulator 35 receives inlet air at a maximum pressure of 2200 or 4500 p.s.i., depending upon the system design, and together with orifice 46, regulates the pressure and flow of air through the bypass circuit to provide a pressure of approximately 1 p.s.i. and a flow of about 100 liters per minute at the outlet of orifice 36. This orifice outlet pressure is sufficient to provide a constant flow of 100 liters per minute through the resistance encountered in the small bore hose 42 and still provide a positive pressure within face mask 41 of the order of 2 inches w.c. In the bypass mode the user is therefore able to breathe without exertion so long as his demand is less than about 100 liters per minute, which is a level sufficient to support moderately strenuous activity without being overly wasteful of the air supply.

The face mask 41 is equipped with the usual spring-loaded exhaust valve 44 and speech diaphragm 45.

In the event a second user, having similar equipment as shown in dashed lines, encounters an emergency, most likely resulting from a total consumption of his air supply, he may share the first user's air supply. The bypass hose 42 is removed from the outlet of orifice 36 by manipulating the quick-disconnect coupling 43, whereupon hose 42 is automatically sealed by the auto-closing valve of coupling 43. The first user continues to receive air through hose 37 without interference in his breathing. Bypass valve 34 is opened and the second user's bypass hose 42' is attached to the outlet of orifice 36 by substituting connector 43' for the removed connector 43. The second user then receives air at the constant bypass flow rate from the first user's tank and bypass circuit.

The invention claimed is:

1. A self-contained breathing apparatus comprising, an air tank containing a supply of highly compressed air and adapted for carriage on the person of a user of the system;

a modular housing containing (1) a main shut-off valve, (2) a main pressure regulator, (3) a bypass shut-off valve and (4) a bypass pressure regulator;

an air tank hose connecting said air tank to said housing for supplying high pressure air thereto, said housing including first conduit means for supplying air received from said tank hose to the inlets of said main and said bypass shut-off valves, second conduit means connecting the outlet of said main shut-off valve with the inlet of said main pressure regulator, third conduit means connecting the outlet of said bypass shut-off valve with the inlet of said bypass pressure regulator, a main supply outlet fitting, a bypass supply outlet fitting, fourth conduit means connecting the outlet of said main pressure regulator with said main supply outlet fitting and fifth conduit means connecting the outlet of said bypass pressure regulator with said bypass supply outlet fitting, said main and said bypass shut-off valves respectively controlling the flow of air from said tank to the inlets of said main and said bypass pressure regulators, said main and said bypass pressure regulators respectively regulating the high pressure of air received from said main and bypass shut-off valves to a first substantially constant moderate pressure and to a second substantially constant pressure substantially below said first moderate pressure, said modular housing being adapted for carriage on the body of a user of the system;

a face mask;

a demand valve mounted on said face mask, said demand valve controlling the pressure and flow of air released therefrom in accordance with the requirements of a user of the system;

a main supply hose connecting said main supply outlet fitting with the inlet of said demand valve; and a bypass supply hose for connecting bypass supply outlet fitting with the interior of said face mask;

said bypass supply outlet being of the manually operable, quick connect/disconnect type.

2. Breathing apparatus as claimed in claim 1 wherein said main and said bypass supply hoses are each comprised of comparatively small bore, thick walled flexible tubing.

3. Breathing apparatus as claimed in claim 1 wherein said modular housing further contains a flow limiting orifice interposed in said fifth conduit means for limiting the flow of air from the outlet of said bypass pressure regulator to the interior of said face mask.

* * * * *